US005307932A

United States Patent [19]

Stout et al.

[11] Patent Number: 5,307,932

[45] Date of Patent: May 3, 1994

[54] HEAVY DUTY ARTICLE CARRIER

[75] Inventors: James T. Stout, Ellijay; James B. Demaio, Marietta, both of Ga.

[73] Assignee: The Mead Corporation, Dayton, Ohio

[21] Appl. No.: 65,277

[22] Filed: May 21, 1993

[51] Int. Cl.[5] ..... B65D 75/00

[52] U.S. Cl. ..... 206/141; 206/162; 206/428; 229/117.13; 229/117.14

[58] Field of Search ..... 206/139, 141, 162, 163, 206/427, 428; 229/117.13, 117.14

[56] References Cited

U.S. PATENT DOCUMENTS 2,841,279 7/1958 Forrer ..... 206/141
4,577,799 3/1986 Oliff ..... 206/427
4,830,267 5/1989 Wilson ..... 206/141
5,221,041 6/1993 Stout et al. ..... 229/117.13
5,221,042 6/1993 Oliff ..... 229/117.13

*Primary Examiner*—David T. Fidei
*Attorney, Agent, or Firm*—Rodgers & Rodgers

[57] ABSTRACT

The top wall of an article carrier is provided with a pair of hand gripping apertures and a number of score lines are arranged to extend from adjacent an end of a hand gripping aperture outwardly in a diverging path toward the corners of the top wall. By this means the top wall of the carrier is rendered especially strong by efficiently distributing the weight of the carrier and its contents so that the caliber of board used may be substantially reduced and economies thereby effected.

11 Claims, 9 Drawing Sheets

HEAVY DUTY ARTICLE CARRIER

TECHNICAL FIELD

This invention relates generally to hand carried article carriers and is particularly concerned with the construction of hand gripping apertures and related scores formed in the top carrier wall.

BACKGROUND ART

U.S. Pat. No. 3,904,036 issued Sep. 9, 1975 owned by the assignee of this invention discloses a fully enclosed article container specially adapted for use with bottles having sloping shoulders.

SUMMARY OF THE INVENTION

A carrier having a bottom wall of rectilinear configuration includes opposed side walls and opposed end walls interconnected at their end edges with each other and which are foldably joined to the side and end edges of the bottom wall. According to this invention in one form, the top wall of the carrier is specially constructed so as to distribute the load in such manner that the carrier may be used effectively with board of a smaller caliber than is used at the present time. One feature of this invention concerns the formation of scores in the top wall which emanate from a point close to a hand gripping aperture and which diverge toward each corner of the top wall but are separated therefrom.

According to a modification of this invention, the divergent scores in top wall are arranged so as to terminate at bevelled corners of the top panel.

BEST MODE OF CARRYING OUT THE INVENTION

Figure 1:
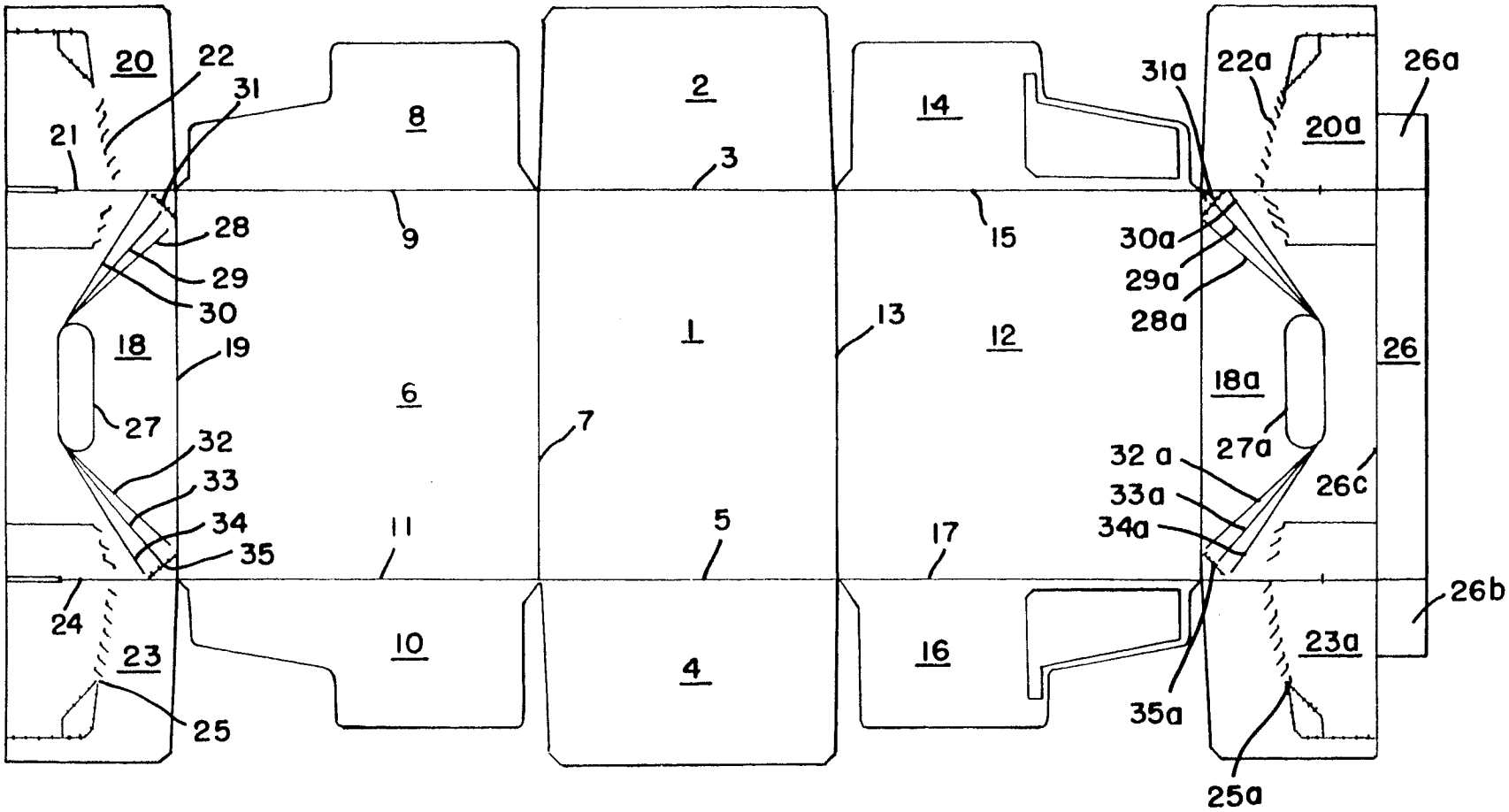
FIG. 1 is a plan view of a blank and its reinforcing strip which utilizes the invention and which is viewed from the inside.

With reference to FIG. 1, the numeral 1 designates the bottom wall of the carrier. Bottom end flap 2 is foldable joined to an end edge of bottom wall 1 along fold line 3. Bottom end flap 4 is foldably joined to bottom wall 1 along fold line 5.

Side wall 6 is foldably joined to a side edge of bottom wall 1 along fold line 7. A side end flap 8 is foldably joined to side wall 6 along fold line 9. Side end flap 10 is foldably joined to side wall 6 along fold line 11.

At the other end of the blank, side wall 12 is foldably joined to bottom wall 1 along fold line 13. Side end flap 14 is foldably joined to side wall 12 along fold line 15. Side wall flap 16 is foldably joined to side wall 12 along fold line 17.

The top wall of the carrier according to this invention is formed of parts located at opposite ends of the blank shown in FIG. 1. Top wall pane 18 is foldably joined to side wall 6 along a fold line 19. Top end flap 20 is foldably joined to an end edge of top wall panel 18 along fold line 21. Portions of a tear strip formed in part in top wall panel 18 and in part in top end flap 20 is designated by the numeral 22. At the other end of top wall panel 18 top end flap 23 is foldably joined to top wall panel 18 along fold line 24. A tear strip 25 is formed in part in top end flap 23 and in part in top wall panel 18.

A hand hole aperture 27 is formed in top wall panel 18 and is of well known construction.

According to this invention, a plurality of score lines such as 28, 29 and 30 emanate from adjacent one end of hand gripping aperture 27 and diverge outwardly toward weakened severance line 31.

At the other end of the hand gripping aperture 27, a plurality of score lines 32, 33 and 34 are formed and emanate from a position adjacent one end of hand gripping aperture 27 and diverge as they approach the weakened line 35 at the outer extremity of the score lines 32, 33 and 34.

The top panel **18*a* at the opposite end of the blank from top panel 18 is identical to panel 18 in all respects except that reinforcing strip 26 is foldably joined to panel 18*a* along fold line 26*c*. This reinforcing strip has an end portion 26*a* at one end and a similar end portion 26*b* at the other end. The numerals used in connection with top panel 18*a* are duplicates of the numerals used in connection with top panel 18 except for the addition of the suffix a. The top end flaps associated with top wall panel 18*a* are designated by the numerals 20*a* and 23*a*. Tear strip 22*a* and tear strip 25*a*** designate the tear strips similar to those at the opposite end of the blank.

Figure 2:
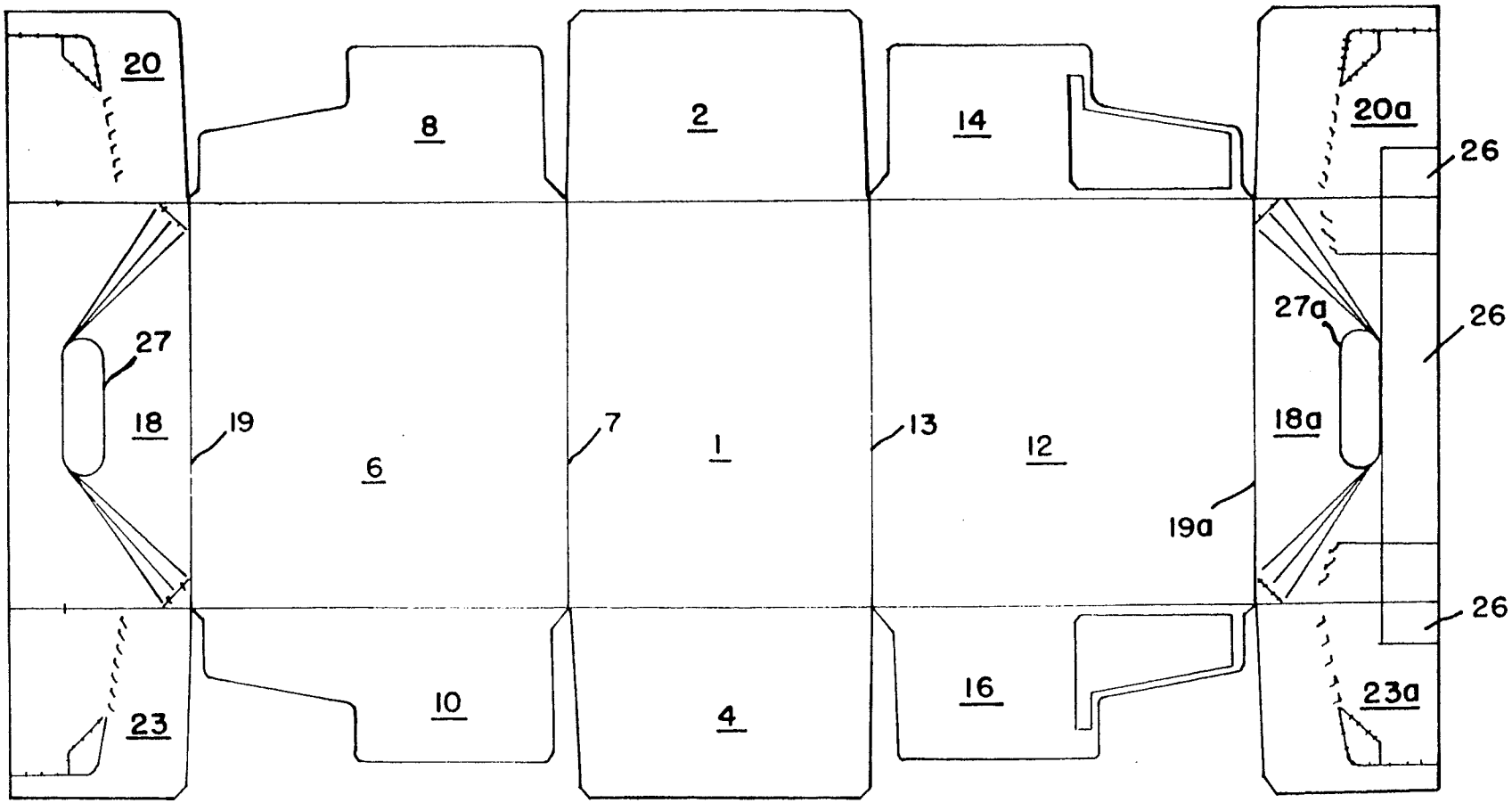
FIG. 2 is a view similar to FIG. 1 but shows the reinforcing strip at one end of the blank which is folded over into flat face contacting relation with the adjacent parts of the blank and secured thereto by adhesive means.

FIG. 2 is simply a representation of the position of reinforcing strip 26 and its associated end portion **26*a* and 26*b*. These elements 26, 26*a* and 26*b* are secured by adhesive to the top panel 18 and to the top end flaps 20 and 23**.

Figure 3:
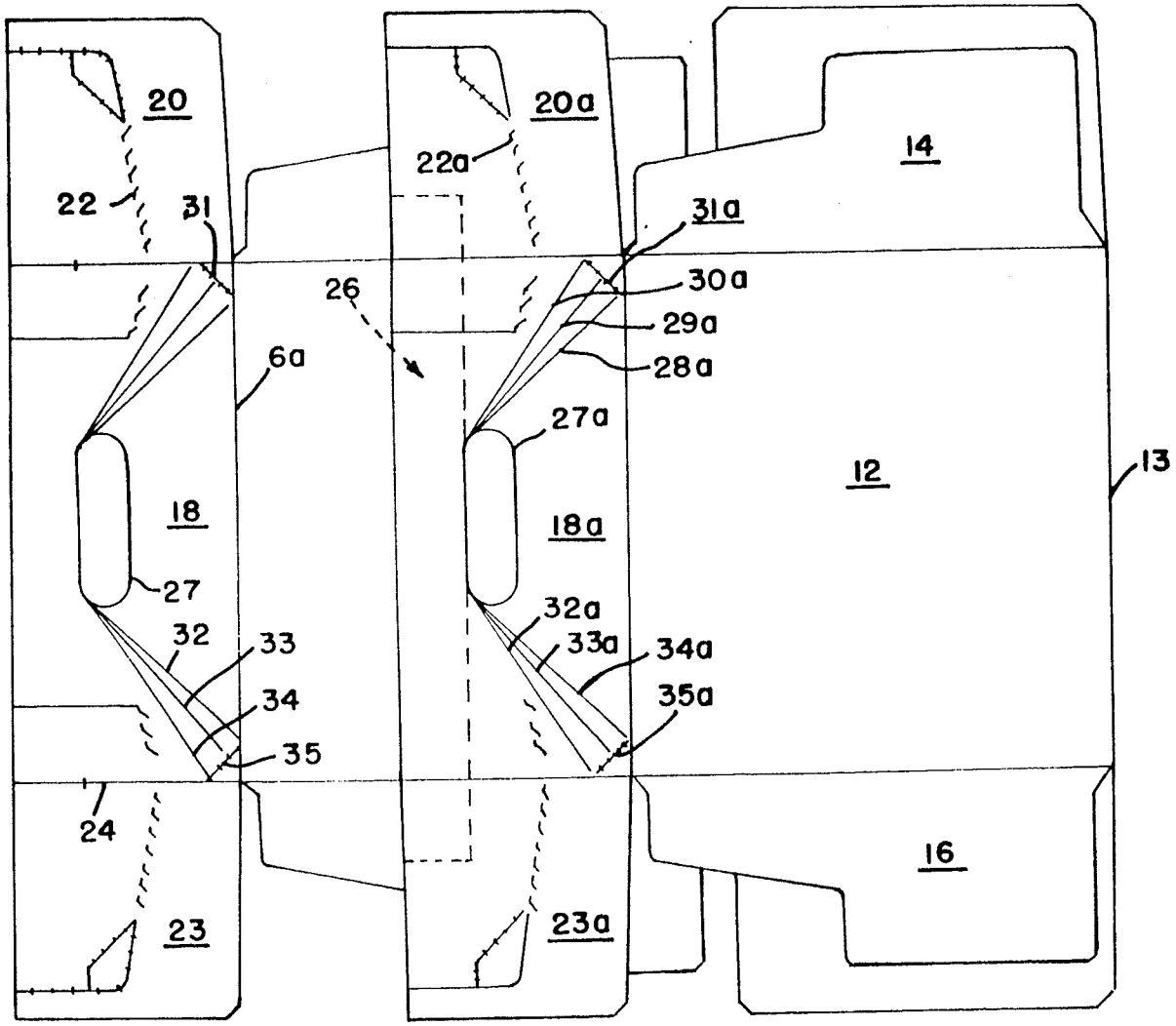
FIGS. 3 and 4 represent stages of manipulation of the blank of FIG. 2 into a collapsed condition as represented by FIG. 4.
Figure 4:
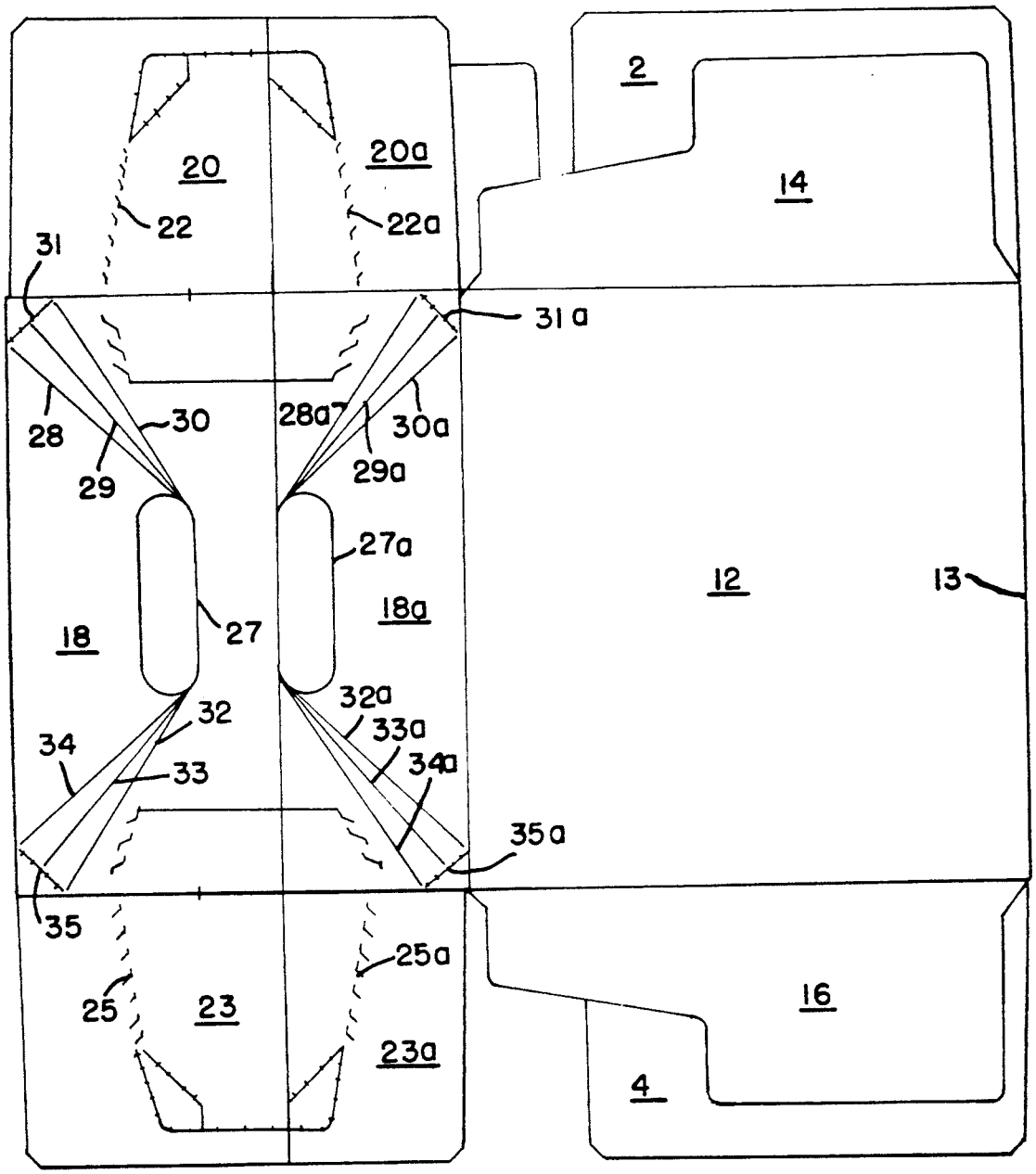

The blank of FIG. 2 is manipulated into the condition represented by FIG. 3 by folding top panel 18 and top end flaps 20 and 23 upwardly and toward the right along fold line **6*a*. Thereafter the side wall panel 12 the top panel 18*a* together with the end flaps 20*a* and 23*a*** are folded upwardly and toward the left along fold line 13 to position these parts as shown in FIG. 4. This operation causes the hand gripping apertures 27 and 27*a* to become associated with and spaced from each other as is well known. The carrier then is shown in FIG. 4 in collapsed condition.

Figure 5:
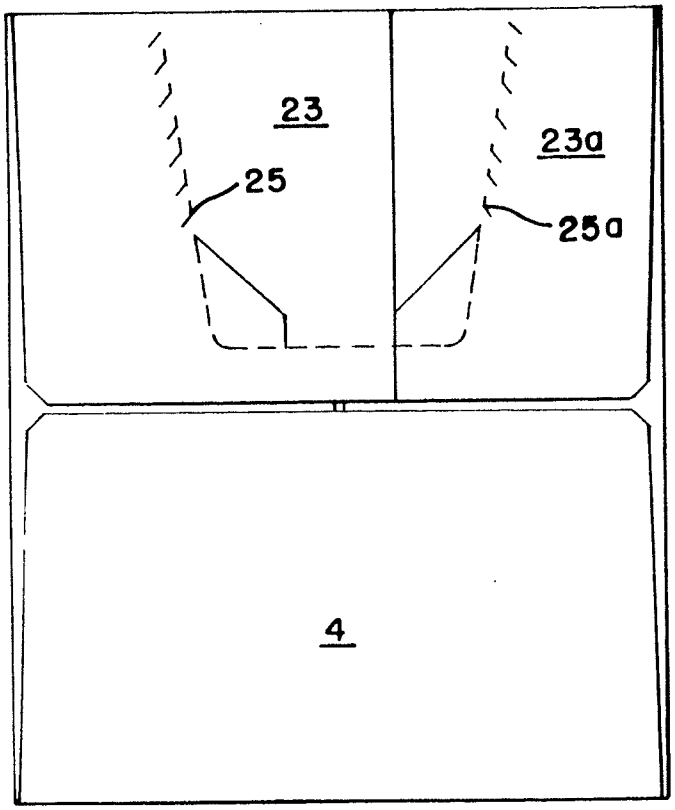
FIG. 5 is an enlarged view of one end of the carrier when set up but shows the carrier at rest.

FIG. 5 shows the carrier from one end when fully set up but which is either not loaded or which is shown without load distribution due to lifting via apertures 27 and 27*a*.

Figure 6:
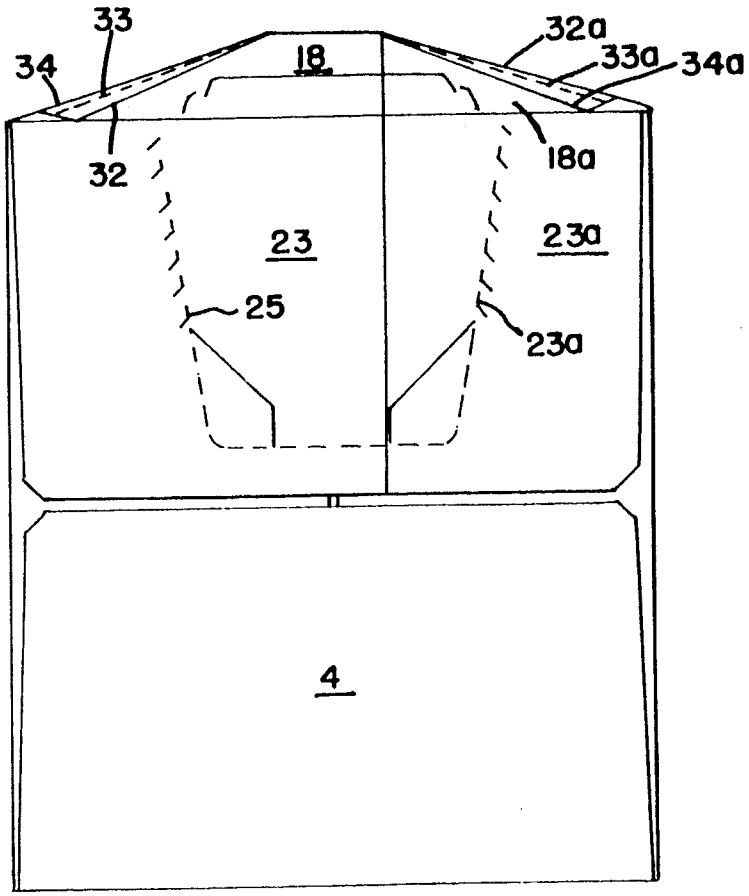
FIG. 6 is a view similar to FIG. 5 but which shows the carrier in loaded condition and with the handle extended upwardly in its normal service position of portability and which effectively distributes the carrier load.

FIG. 6 is similar to FIG. 5 but shows the carrier loaded and lifted by grasping apertures 27 and 27*a*. This view shows the scores 32, 33, 34 and 32*a*, 33*a* and 34*a* formed in top panels 18 and 18*a*.

Figure 7:
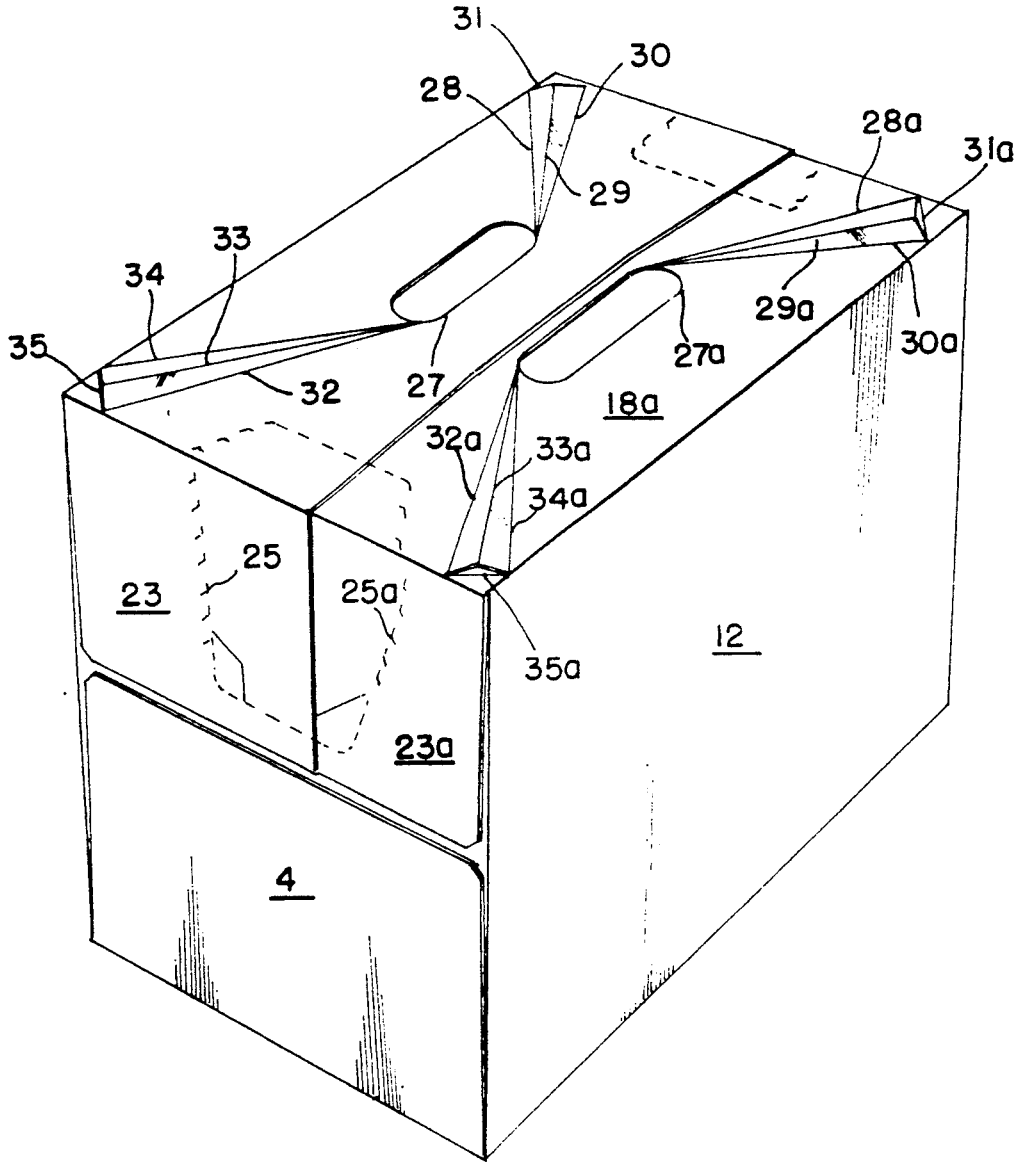
FIG. 7 is a perspective view of the carrier formed according to this invention which is fully closed and set up.

In FIG. 7, the near end of the carton shows the weakened severance lines 35 and 35*a* which facilitate upward folding of the score lines 32, 33, 34 and 32*a*, 33*a* and 34*a*.

FIGS. 8–12 inclusive disclose a modification of the invention wherein the score lines formed in the top wall terminate at bevelled corners of the top wall which are adjacent to bevelled corner strips.

Figure 8:
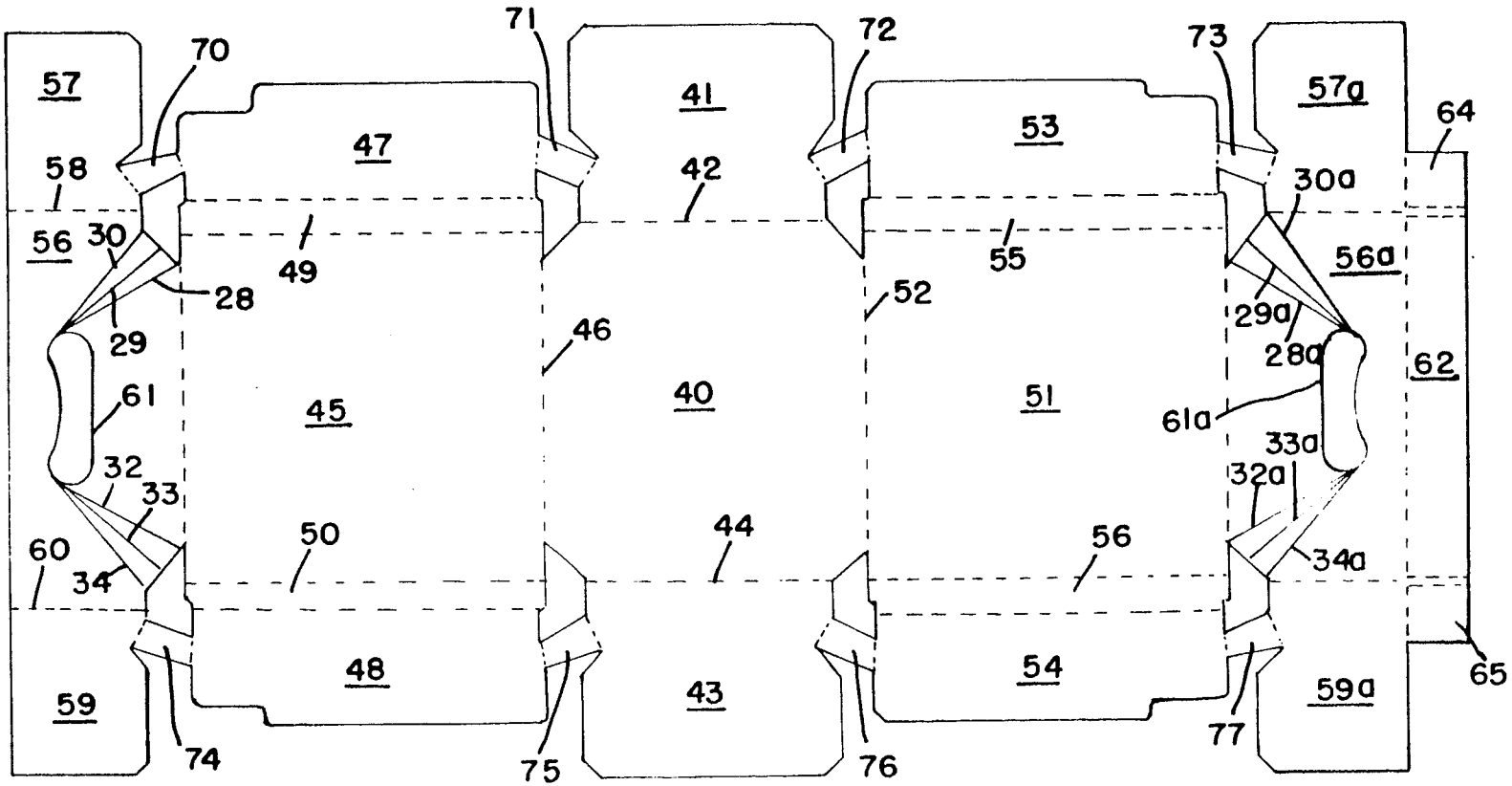
FIG. 8 is a plan view of a blank formed according to a modification of this invention which utilizes bevelled corners in order to effect efficient distribution of the load.

With respect to FIG. 8, the bottom wall is designated by the numeral 40 and bottom end flap 41 is foldably joined to bottom wall 40 along fold line 42. Bottom end flap 43 is foldably joined to bottom wall 46 along fold line 44. Side wall 45 is foldably joined to bottom wall 40 along fold line 46. Side flaps 47 and 48 are foldably joined to the bevelled strip 49 and 50 respectively.

Side wall 51 is foldably joined to bottom wall 40 along fold line 52. End flaps 53 and 54 are foldably joined to bevelled strips 55 and 56 as is obvious.

The top wall of the carrier is formed of two parts designated 56 and 56*a*. Top end flaps 57 are foldably joined to top wall panel 56 along fold line 58. Top end flap 59 is foldably joined to top wall panel 56 along fold line 60. A hand gripping aperture 61 is formed in top wall panel 56 and a reinforcing strip 62 is foldably joined to top wall panel 56 along fold line 62*a*. The reinforcing strip 62 includes end portions 64 and 65. End flap at the opposite end of the blank are designated by the same numerals with the suffix a added as are used in connection with top wall panel 56.

The end flaps of the carton are interconnected by foldable web structures 70–77. This construction is similar to that shown in U.S. Pat. No. 4,216,861.

Figure 9:
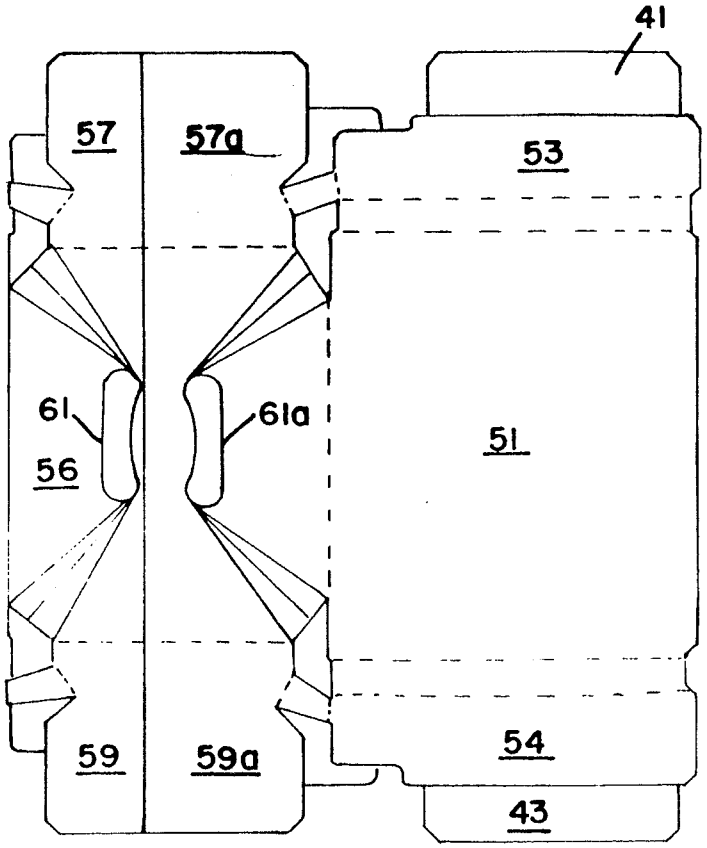
FIG. 9 is a view showing the carrier blank of FIG. 8 in assembled and collapsed condition.

FIG. 9 shows the blank of FIG. 1 manipulated into finished condition and shown in collapsed form.

Figure 10:
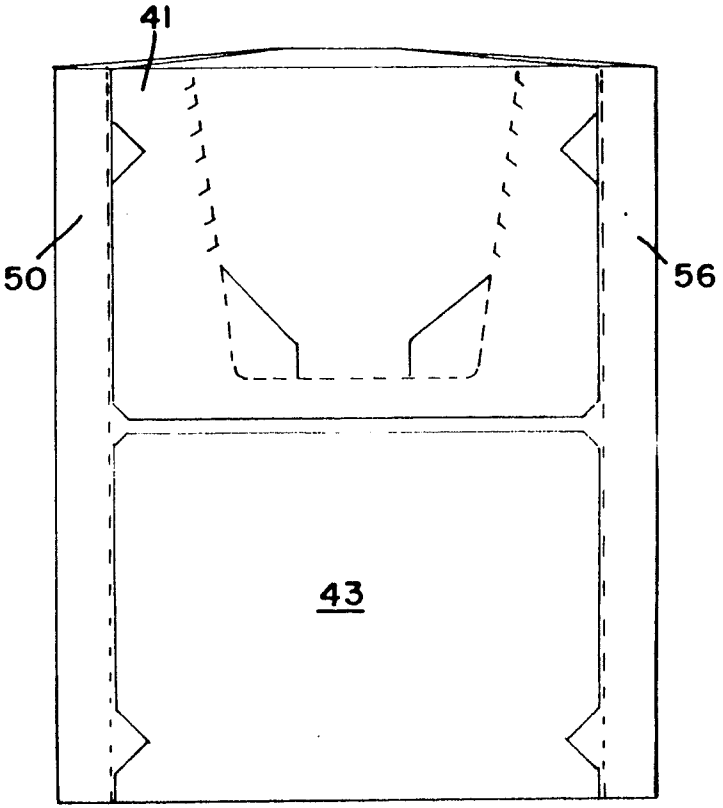
FIG. 10 is a view of one end of the carrier of FIG. 9 when set up but at rest.

FIG. 10 shows the carrier of FIG. 8 set up but not lifted under load.

In accordance with the modification of the invention, vertically disposed bevelled strips are formed at each corner of the carton.

Figure 12:
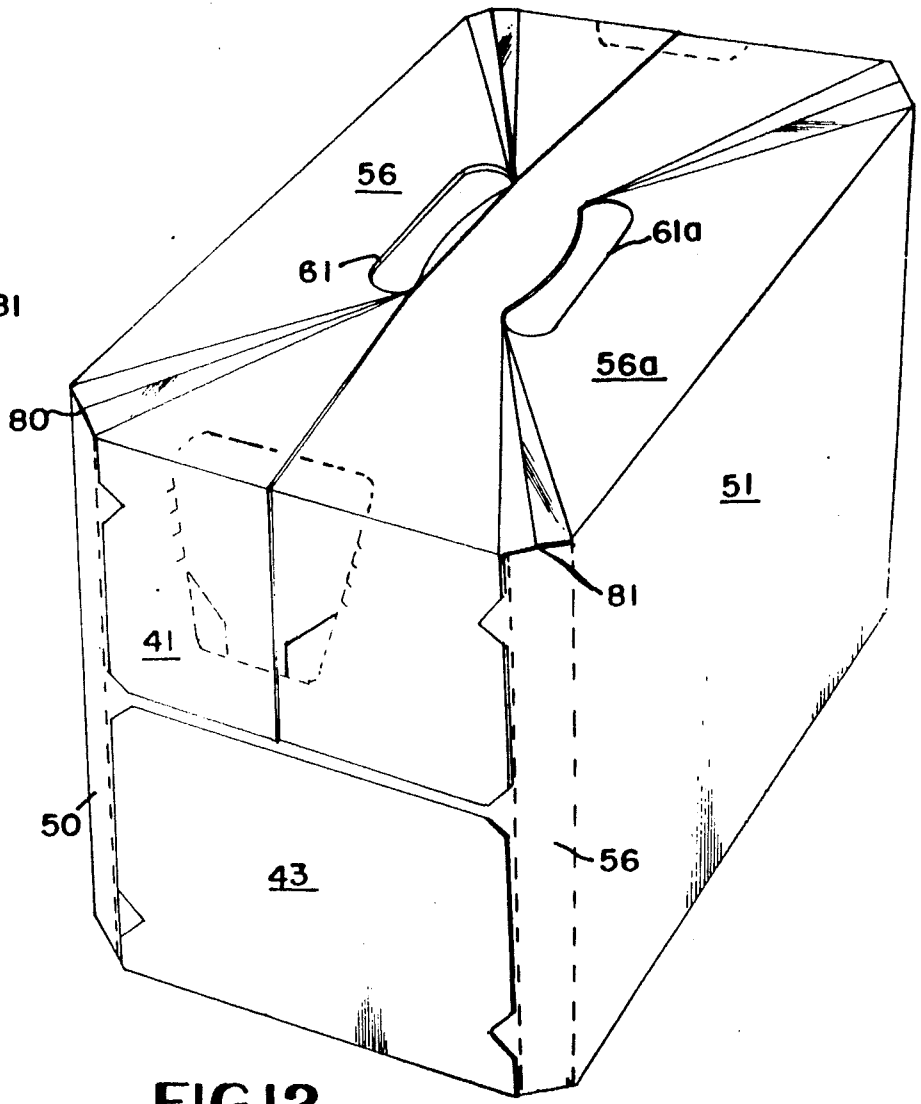
FIG. 12 is a perspective view of a set up carrier formed from the blank of FIG. 8 and which utilizes bevelled corner panels.
Figure 11:
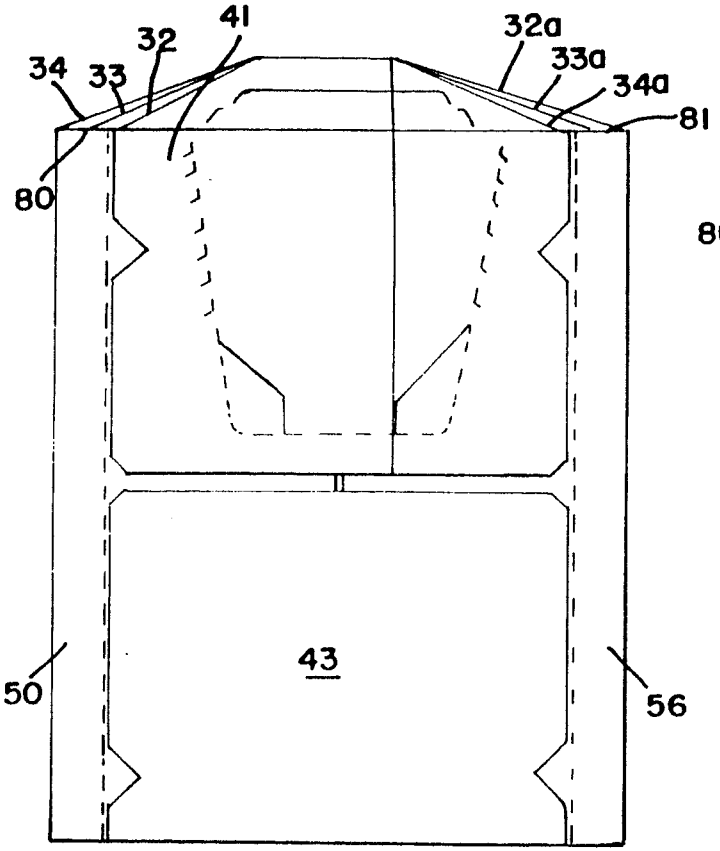
FIG. 11 is a view similar to FIG. 10 but which shows the elements of the top wall in stressed upwardly extended condition whereby, load is distributed according to this invention.

As is obvious from FIGS. 11 and 12 the score lines such as 32–34 and 32*a*–34*a* are bowed upwardly especially as is apparent in FIG. 11 and portions of the weight of the load distributed by these score lines. The top ends of bevelled panels 50 and 56*a* are designated at 80 and 81 which coincide with the ends of the score lines such as 32–34 and 28–30 provided in the top panels 56 and 56*a*.

We claim:

1. An article carrier comprising a bottom wall, side walls foldably joined along their bottom edges to side edges of said bottom wall, end walls foldably joined along their bottom edges to end edges of said bottom wall and foldably joined along their side edges to end edges of said side walls, a top wall having opposed side edges foldably joined to the top edges of said side walls respectively and having opposed end edges foldably joined respectively to the top edges of said end walls, a pair of finger receiving hand hole apertures formed in said top wall, and a plurality of diverging score lines formed in said top wall and extending from the region of each of said hand hole apertures toward each corner of said top wall, and a diagonal weakened severance line formed in said top wall inwardly of and spaced from each corner for separating said score lines from the associated corner.

2. An article carrier according to claim 1 wherein said hand hole apertures comprise a pair of finger receiving apertures and a plurality of score lines formed in four groups ins aid top wall, each group extending from one end of one of said apertures toward the adjacent corner of said top wall.

3. An article carrier according to claim 2 wherein the score lines of each group converge toward a point adjacent one of said apertures.

4. An article carrier according to claim 1 wherein said score lines terminate at the carrier corners or at a location spaced inwardly from said carrier corners.

5. An article carrier comprising a bottom wall, side walls foldably joined along their bottom edges to side edges of said bottom wall, end walls foldably joined along their bottom edges to end edges of said bottom wall and foldably joined along their side edges to end edges of said side walls, a top wall having opposed side edges foldably joined to the top edges of said side walls respectively and having opposed end edges foldably joined respectively to the top edges of said end walls, a finger receiving hand hole aperture formed in said top wall, and a plurality of score lines formed in said top wall and extending from the region of said aperture toward each corner of said top wall wherein said score lines terminate at a line extending diagonally between said side and end walls adjacent each corner of said carrier, said diagonally extending line being formed by a weakened severance line effective to separate when the carrier is lifted.

6. An article carrier according to claim 5 wherein a bevel strip is interposed between said side end walls at each corner of the carrier to form bevelled corners and the top edge of each of said bevel strips extends along said diagonally extending line.

7. An article carrier according to claim 6 wherein said score lines extend from the region of said aperture to said bevelled corners.

8. An article carrier comprising a bottom wall, side walls foldably joined along their bottom edges to side edges of said bottom wall, end walls foldably joined along their bottom edges to end edges of said bottom wall and foldably joined along their side edges to end edges of said side walls, a top wall having opposed side edges foldably joined to the top edges of said side walls respectively and having opposed end edges foldably joined respectively to the top edges of said end walls, a finger receiving hand hole aperture formed in said top wall, a plurality of score lines formed in said top wall and extending from the region of said hand hole aperture toward each corner of said top wall, and a bevel strip disposed at each corner of the carrier to form bevelled corners and which strip extends from said bottom wall to said top wall with one side edge of said strip adjoined to the adjacent end of the associated side wall and with the other side edge of said strip adjoined to the adjacent end of the associated end wall.

9. An article carrier according to claim 8 wherein at least one score line is formed in said top wall and extends from the region of said aperture to said bevelled corner associated with each of said bevel strips.

10. An article carrier comprising a bottom wall, side walls foldably joined along their bottom edges to side edges of said bottom wall, end walls foldably joined along their bottom edges to end edges of said bottom wall and foldably joined along their side edges to end edges of said side walls, a top wall having opposed side edges foldably joined to the top edges of said side walls respectively and having opposed end edges foldably joined respectively to the top edges of said end walls, a pair of finger receiving hand hole apertures formed in said top wall, and a plurality of diverging score lines formed in said top wall and extending from the region of each of said hand hole apertures toward each corner of said top wall, and a diagonal weakened severance line formed in said top wall inwardly of and spaced from each corner for separating said score lines from the associated corner and three of said score lines extending from adjacent said hand hole apertures to each of said weakened severance lines.

11. An article carrier comprising a bottom wall, side walls foldably joined along their bottom edges to side edges of said bottom wall, end walls foldably joined along their bottom edges to end edges of said bottom wall and foldably joined along their side edges to end edges of said side walls, a top wall having opposed side edges foldably joined to the top edges of said side walls respectively and having opposed end edges foldably joined respectively to the top edges of said end walls, a pair of finger receiving hand hole apertures formed in said top wall, and a plurality of diverging score lines formed in said top wall and extending from the region of each of said hand hole apertures toward each corner of said top wall, and a diagonal weakened severance line formed in said top wall inwardly of and spaced from each corner for separating said score lines from the associated corner and a vertical bevel strip disposed ate each corner of the carrier and said score lines being arranged to extend from said apertures to the upper end of each of said bevel strips.

* * * * *